United States Patent [19]

Langley et al.

[11] 4,426,262

[45] Jan. 17, 1984

[54] PROMOTION OF PT-IR CATALYTIC ELECTRODES WITH LEAD, TANTALUM, RUTHENIUM AND OXYGEN

[75] Inventors: Robert C. Langley, Millington; Herbert Myers, South Orange, both of N.J.

[73] Assignee: Engelhard Corporation, Iselin, N.J.

[21] Appl. No.: 372,906

[22] Filed: Apr. 29, 1982

[51] Int. Cl.[3] ..... C25B 1/34

[52] U.S. Cl. ..... 204/98; 204/123; 204/290 R; 204/290 F; 204/292; 204/293

[58] Field of Search ..... 204/290 R, 290 F, 292–293, 204/98, 128; 427/229, 227

[56] References Cited

U.S. PATENT DOCUMENTS

| | | | |
|---|---|---|---|
| 3,177,131 | 4/1965 | Angell et al. | 204/290 F |
| 3,603,414 | 5/1972 | Martinsons et al. | 204/290 F |
| 3,691,052 | 9/1972 | Langley | 204/290 F |
| 3,718,551 | 2/1973 | Martinsons | 204/290 F |
| 3,773,555 | 11/1973 | Cotton et al. | 204/290 F |
| 3,778,307 | 12/1973 | Beer et al. | 427/229 |
| 3,926,751 | 12/1975 | DeNora et al. | 204/290 F |
| 4,157,943 | 6/1979 | Scarpellino et al. | 204/290 F |
| 4,203,810 | 5/1980 | Warne et al. | 204/290 F |

*Primary Examiner*—R. L. Andrews

[57] ABSTRACT

Platinum and iridium in catalytic electrodes for electrochemical uses is partially replaced with lead ruthenate-tantalum oxide composite. Electrodes are fabricated by first coating a film-forming metal substrate with a platinum-iridium composite undercoat, then overcoating with a composite containing lead, ruthenium, tantalum, platinum, iridium and oxygen. The most preferred anodes have a titanium substrate initially coated with approximately at least 2 gm/m$^2$ of 70:30 $^w$/o Pt:Ir composite, followed by about 20 gm/m$^2$ of a composite having the nominal composition of 22.2$^w$/o $Pb_2Ru_2O_6$; 66.6 $^w$/o $Ta_2O_5$; 7.9 $^w$/o Pt and 3.4 $^w$/o Ir. The outer layer of the prepared anode contains from about 10 to about 16 $^w$/o lead, from about 40 to about 65 $^w$/o tantalum, from about 5 to about 7.5 $^w$/o ruthenium, from about 6.0 to about 10 $^w$/o platinum, from about 2.5 to about 5 $^w$/o iridium, and from about 10 to about 20 $^w$/o oxygen. These electrodes may be used in acidic, neutral or alkaline solutions. Typical uses include production of chlorine and chlorine compounds and electrowinning of metals, such as zinc.

14 Claims, 1 Drawing Figure

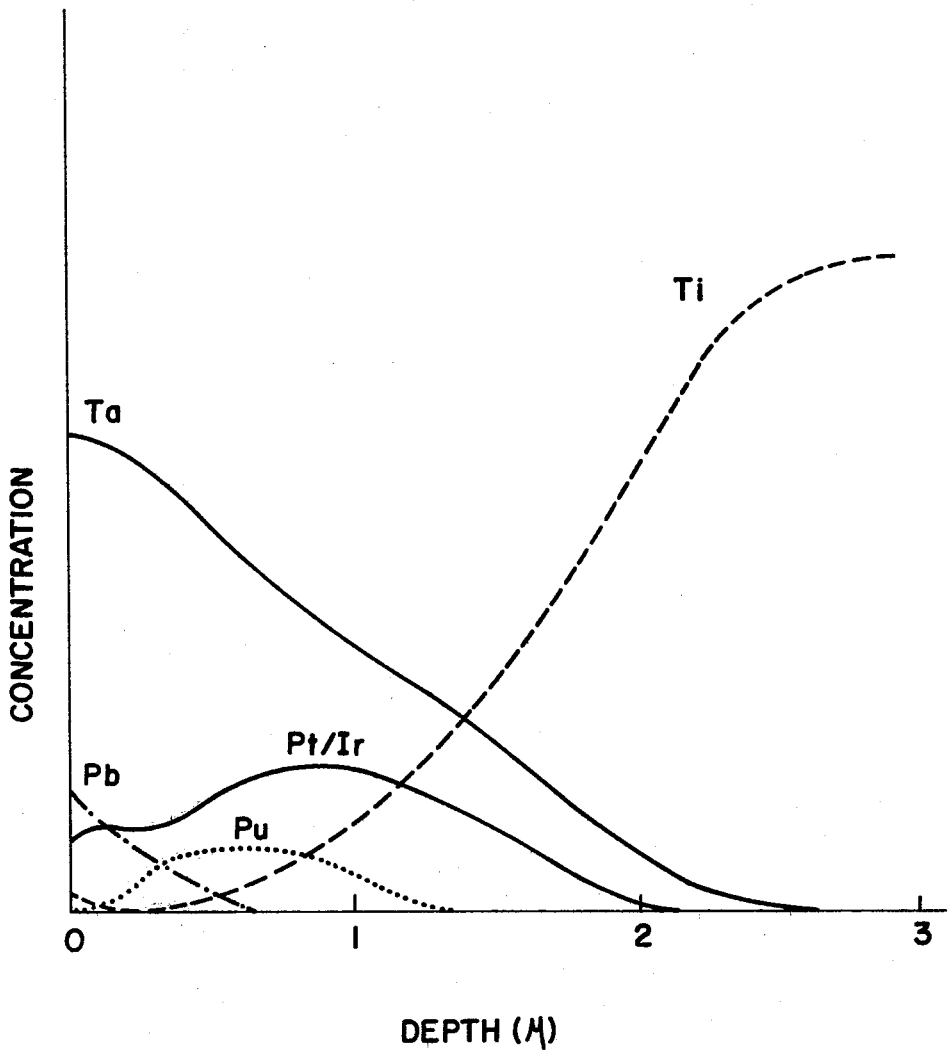
Ti
Ta
CONCENTRATION
Pt/Ir
Pb
Pu
0
1
2
3
DEPTH (μ)

PROMOTION OF PT-IR CATALYTIC ELECTRODES WITH LEAD, TANTALUM, RUTHENIUM AND OXYGEN

BACKGROUND OF INVENTION

Platinum-iridium coated electrodes of the type described in U.S. Pat. No. 3,177,131 have found widespread use in electrolytic production of chlorine and other chlorine-containing products. These anodes possess three of the four qualities which are particularly desirable in commercial electrodes: long life, high efficiency and high selectivity. However, the fourth desirable quality, low initial cost, is not obtained, as the initial cost of these anodes is quite high compared to the relatively inexpensive materials which were used for anodes in electrochemical applications early in this century. For instance, graphite anodes were used to produce chlorine and lead anodes were used for electrowinning. Even though these materials had rather limited life and only moderate efficiency, they were extensively used because they were inexpensive and readily available.

Even though modern precious metal catalytic electrodes have a high initial cost, they can be considered economical in view of their high efficiency and long life. When used in a typical diaphragm cell for producing chlorine, life is measured in terms of years, with from about 3 to 5 years being considered typical, and more than 10 years exceptional. Shorter lives are considered undesirable, since in addition to labor, the cost of the anodes replacement requires an extended shutdown of the cell and a consequent loss of production.

The efficiency of precious metal electrodes is generally guite good. Efficiency is typically thought of in terms of the amount of electrical energy required to produce a given quantity of the desired product. This depends primarily on two factors, over-voltage and selectivity. Activation over-voltage is the difference between electrical potential required to obtain the desired production at the operating current and the standard half-cell potential for the desired reaction. In chlorine production, under typical conditions, the activation over-voltage of precious metal-coated electrodes is typically less than about 100 millivolts over the life of the electrode. This represents about a 4% loss in a typical process running at 3 to 4 volts. When the activation over-voltage exceeds about 200 millivolts, the power savings obtainable with new electrodes could be as high as about 8%, which might normally justify replacement. For comparison, the over-voltage obtained with graphite electrodes typically ranges from about 300 to about 500 millivolts.

Selectivity of an electrode is the ability of the electrode to preferentially catalyze the reaction which produces the desired products. In chlorine production, precious metal-coated electrodes typically produce about 1 to 3 v/o (volume percent) oxygen, which is undesirable, and lesser amounts of undesirable chlorine-oxygen compounds. The literature reports that, under similar conditions, graphite electrodes typically produce about 4% oxygen along with chlorinated organics and carbon dioxide. Since the raw material for chlorine is common salt, the major production expenses are the capital cost of the plant and the cost of the electrical energy for the electrolysis. Thus, even though more modern precious metal-coated electrodes initially cost substantially more than obsolescent graphite electrodes, they are ultimately more economical, as they are more efficient.

The platinum-iridium anode coatings of commerce are normally specified as containing 70% Pt:30% Ir by weight of the metal, even though the metals are thought to form at least a thin surface film of oxide which catalyzes the electrolysis reaction with the iridium being present throughout as the oxide. These anodes are prepared by making a solution of salts or resinates of the two metals in an appropriate solvent, such as alcohol, for salts or a mixture of essential oils for resinates, applying multiple thin coats, and firing in air or other oxidizing atmosphere between 350° and 550° C. Unfortunately, the cost of iridium is comparable to that of platinum, and both have escalated rapidly in recent years. In chlorine production, platinum-iridium-coated anodes generally evolve less than about 1% oxygen, which is considered very good.

However, some of the platinum group metals, while still precious, are considerably less precious than platinum, and further, their prices have not risen as rapidly as that of platinum; so in the 60's, ruthenium oxide-coated anodes became commonly used, while platinum-iridium was used on a smaller scale. The commercial ruthenium oxide coatings are thought to be prepared as described in U.S. Pat. No. 3,632,498, by dissolving $RuCl_3$. $1-3H_2O$ and $TiCl_3$ or $TaCl_5$ in alcohol, applying thin coats of the solution to titanium, and firing each coat in air in the temperature range of 350°–600° C. However, in chlorine production, the ruthenium oxide-coated electrodes produce slightly more oxygen than Pt-Ir electrodes. This represents a considerable waste of electrical energy and may require further purification of the chlorine. Ruthenium oxide-coated electrodes, such as are known to the prior art, are not generally considered suitable for use in many acidic media, such as are encountered in electrowinning.

Precious metal-coated titanium anodes are usually dimensionally stable and have very long life in brine electrolyses, as compared to graphite, but there is a need to obtain alternative coatings incorporating smaller amounts of the more expensive precious metals while achieving comparable or even longer life at lower cost, or at least without unduly increasing the cost of the coating. Further, high selectivity must be maintained.

In the case of platinum-iridium, customers may typically specify coating loading in the range of 5–20 grams per square meter in expectation of a life of more than 7 years in a chlorate cell. Multiple coating applications may be needed to obtain this loading range, so cost of application can be a significant part of the overall cost. Longer life could be obtained by increasing the loading further, but as a practical matter, this is not usually done because of precious metal and labor costs.

Prior to this invention, it was suggested that powdered lead ruthenate could be used as an electrocatalyst in chlorine production in U.S. Pat. No. 3,691,052, which describes a technique of forming the catalytic coating by firing a mixture of a low melting glass and lead ruthenate at a temperature above the melting point of the glass. However, these coatings have not been found to be sufficiently durable to gain wide commercial acceptance. If higher melting glasses are used, the durability can be increased somewhat, but the extreme reactivity of titanium substrates presents difficulties in fabrication. As is well known, titanium is a powerful reducing agent and tends to oxidize very rapidly at elevated temperatures.

OBJECTS OF THE INVENTION

An object of the present invention is to provide promoted anode coatings which have efficiency and life which are substantially equivalent to the prior art platinum-iridium composite coatings over a wide range of conditions, but which have reduced platinum-iridium content and can be used for production of chlorine and chlorine-containing compounds. A further object is to provide compositions which may be substituted for a portion of the platinum-iridium in the exterior coats of anodes prepared according to prior art techniques, while retaining the desirable properties of these prior art electrodes.

SUMMARY OF THE INVENTION

It has been discovered that when anodes are prepared according to the technique set forth in U.S. Pat. No. 3,177,131, lead ruthenate and a tantalum compound can be substituted for a portion of the platinum-iridium in the compositions used to apply the outer layers without any significant degradation of the properties of the resulting promoted electrode. In many cases, the platinum-iridium content can be reduced by a factor of from about 3 to 4, while maintaining the life, efficiency and selectivity of the prior art electrodes at greatly lower cost. The anodes of the invention are obtained by first coating a valve metal substrate, such as titanium or tantalum, with a thin layer containing thermally decomposable platinum iridium compounds, firing in an oxidizing atmosphere, then overcoating with an admixture consisting essentially of lead ruthenate and a thermally decomposable compound of a film-forming metal along with platinum and iridium compounds, and again firing the anode in oxidizing atmosphere. A platinum-iridium composite topcoat may also be applied. The composite electrode formed has a titanium substrate covered with a coating having a platinum-iridium rich inner layer, and an outer layer consisting essentially of from about 10 to about 16% lead, from about 5 to about 7.5 w/o ruthenium, from about 15 to about 20 w/o oxygen, from about 40 to about 65 w/o tantalum, and from about 8.5 to about 15 w/o platinum-iridium.

DESCRIPTION OF THE DRAWINGS

FIGS. 1 and 2 compare the concentration of metals in the coatings with increasing depth.

DETAILED DESCRIPTION OF THE INVENTION

The electrodes of the present invention are formed on a film-forming or valve metal substrate, which for brine electrolysis includes tantalum, zirconium, niobium, molybdenum, tungsten, hafnium and titanium. In many cases, the substrate will actually be a titanium-clad conductive metal, such as copper or aluminum, since the electrical conductivities of copper and aluminum are so much greater than that of titanium. The substrate may be in the form of a plate, screen, mesh, or other convenient shape. By titanium, we mean either the essentially unalloyed metal or any of its film-forming alloys. Of course, all titanium contains some oxygen, but normal amounts can be tolerated. For brine electrolysis, other film-forming metals include zirconium and niobium. The term film-forming metal is understood in the context of the proposed electrolyte, thus for electrolysis of fluorine-containing electrolytes, chromium can be a film-forming metal. First, a thin layer or coating of platinum-iridium rich composite is formed on the substrate. This ratio of platinum to iridium in this composite can vary widely. Typical coatings will contain from about 20 to about 40 w/o iridium, and from about 80 to about 60 w/o platinum, calculated based on the metal. It appears that substantially all of the iridium is present as the oxide and that at least a dull gray film of platinum oxide is present after firing in an oxidizing atmosphere. In use, a black oxide appears to be present. The term "platinum-iridium composite" should be understood to include any compounds, mixtures or solid solutions of platinum and iridium, whether in the form of the metal, oxides or of compounds, mixtures or solid solutions of metals and oxides. Small amounts of common minor impurities have not been found to cause problems. The thickness or loading is typically expressed in grams of alloy per square meter ($g/m^2$) of substrate, since the surface of coating substrate is generally rather rough or non-planar. Typical loadings range from about 1 to about 4 $g/m^2$. The preferred range of loadings ranges from about 2 to about 3 $g/m^2$.

Many well-known prior art methods can be used to apply the platinum-iridium rich layer. In the preferred methods of applying this layer, an admixture of a platinum group metal compound and an organic vehicle is formed, applied to the substrate, the vehicle removed, and the compounds decomposed in an oxidizing atmosphere. The admixture may be easily applied by brushing, dipping, spraying or similar methods. One convenient method is described in U.S. Pat. No. 3,177,131, which is incorporated herein by reference.

The composition of the outer layers of the electrode may vary widely. As applied, typical compositions will contain from about 65 to about 75 w/o thermally decomposable film-forming metal compound, from about 20 to about 25 w/o lead ruthenate, and from about 10 to about 15 w/o of the abovedescribed Pt and Ir compounds. The lead ruthenate may range in composition from $Pb_2Ru_2O_6$ to $Pb_2Ru_2O_7$, depending upon the oxygen content. For brine electrolysis,, the preferred thermally decomposable, film-forming metal compound is tantalum chloride. In the fired film, it is preferred that the amount of tantalum oxide range from about 65 to about 70 w/o, with the amount of Pt-Ir (calculated based on the metal) ranging from about 10.5 to about 12.5 w/o, and the balance being lead-ruthenate. The term "lead ruthenate-tantalum oxide composite" should be understood to mean a compound, solid solution, mixture or dispersion of lead, ruthenium, tantalum and oxygen, whether or not all of the lead and ruthenium are associated in the form of the compound lead ruthenate. Similarly, the term "lead ruthenate-tantalum oxide-Pt-Ir composite" should be understood to mean a compound, solid solution, mixture or dispersion of lead, ruthenium, tantalum, platinum, iridium and oxygen, whether or not all of the lead and ruthenium are associated as lead ruthenate. The thickness or loading of this layer is also commonly expressed in $g/m^2$. Preferred loadings range from about 10 to about 20 $g/m^2$. Heavier loadings can be used, if it is economically desirable to do so. The outer layers may be applied by techniques which are essentially similar to those mentioned earlier in reference to applying the Pt-Ir composite layer. The preferred method of application is to disperse or slurry lead ruthenate powder in a volatile polar aqueous or organic solvent, such as an alcohol or glycol. The appropriate amounts of the chloride salts of tantalum, platinum and iridium may be added to the solvent, and the admixture applied to the substrate by brushing, dipping or spraying, the solvent removed and the anode fired in an oxidizing atmosphere. Appropriate temperatures may be determined by those skilled in the art, based upon the exact composition of the substrate and coating, but temperatures ranging from 350° to 550° C. are generally suitable. Temperatures of about 550° C. are most preferred. The product formed has a platinum and iridium rich layer adjacent to the substrate covered by a layer consisting essentially of from about 10 to about 16 w/o lead, from about 5 to about 7.5 w/o ruthenium, from about 40 to about 65 w/o tantalum, from about 10 to about 20 w/o oxygen, from about 6 to about 10 w/o platinum, and from about 2.5 to about 5 w/o iridium. After the outer layer has been applied, the anode may be used as is or a further layer of Pt-Ir composite (a topcoat) may be applied as previously. If the topcoat is to be applied, the amount of Pt-Ir alloy in the undercoat, and the intermediate coat may be varied accordingly. If a Pt-Ir topcoat is used, it is preferred that its loading vary from about 1 to about 4 g/m$^2$, and the loading of the Pt-Ir undercoat may be about 1 to about 4 g/m$^2$. More preferably, the loadings for each will vary from about 2 to about 3 g/m$^2$.

EXAMPLE 1

Lead ruthenate powder was made by the following synthesis.

Powdered Ru metal (15.5 g) was suspended in 30 ml NaOH solution (25 g NaoH) in a three neck flesk equipped with magnetic stirrer and condenser. 800 ml of hypochlorite solution (4–6% NaOCl) was poured in, and the mixture was stirred for three hours at room temperature.

The solution was filtered through a medium fritted filter. The pH was adjusted to 7 with concentrated nitric acid. 125 ml of lead nitrate solution (51 g $Pb(NO_3)_2$) was poured in, the mixture was stirred for one hour, then allowed to settle overnight.

The precipitate was removed using #42 Whatman paper on a Buchner funnel, then washed on the filter with 30 l. of water and dried by vacuum.

The black powder was sifted through #50, #100, #200 and #325 mesh sieves. Essentially all of the powder passed the #325 sieve, and Coulter analysis gave the following particle size distribution:

10% less than 0.60 micron
50% less than 1.12 micron
90% less than 3.40 micron

Initial attempts at x-ray diffraction gave only a weak pattern, indicating an extremely small crystallite size. A sample of the powder was heated in air at 550° C. for one hour. This treatment caused increased crystallite size, and XRD (X-Ray Diffraction) identified the material as consisting of from about 80 to 85 w/o lead ruthenate.

Attempts were made to suspend the as-prepared powder in n-butanol. However, the powder was so reactive that it ignited the alcohol at room temperature. Powder heated in air to 550° C. was less reactive and could be suspended safely in n-butanol.

EXAMPLE 2

Lead ruthenate powder, substantially free of impurities, was prepared following the procedure of Example 1 on the same scale, except that the pH of the original caustic solution of sodium ruthenate was not adjusted before addition of lead nitrate, but was allowed to remain in the range of 11 to 12; and the dried filter cake was calcined at 550° C. for 30 minutes, then lixiviated with hot water to remove the impurities. Hot water washings were repeated until the supernatant liquid contained less than 10 ppm of Na and Pb ions. X-Ray diffraction indicated that this procedure yielded essentially pure leadruthenate.

This synthesis proved reproducible both on the original scale and when scaled up to yield 600 g of product. Yields of 90% or greater, based on starting Ru metal, were realized. The powder did not ignite butanol. When surface area was measured using the Brunauer-Emmett-Teller (BET) nitrogen adsorption technique, the indicated surface area was found to be from about 32 to about 36 m$^2$/g. In appearance, the powder was fluffy and fine. The average particle size was in the neighborhood of about 0.5 to about 1.5 microns, therefore the powder could be suspended in alcohol, ultimately resulting in smooth appearing coatings on titanium.

EXAMPLE 3

The electrodes described herein were prepared on a substrate of a commercially pure low-iron titanium sheet which, prior to electrode preparation, was pretreated by standard and conventional procedures, that is, degreasing followed by surface roughening by blasting with abrasive grit, washing with a detergent and air drying.

As a control, lead ruthenate powder, as prepared in Example 2, was slurried in n-butanol, applied to titanium, then fired in air to determine adherence. Firing temperatures of 450°, 550°, and 650° C. for 15 minutes at temperature were used. Using the so-called "Scotch Tape Test" (ASTM B-571-79), there was no adherence on any firing cycle. This demonstrates the difficulty of incorporating lead ruthenate directly into a coating.

EXAMPLE 4

Composite films of lead ruthenate-tantalum oxide in varying proportions of 25:75, 50:50, and 75:25 parts by weight were prepared on the three firing cycles mentioned above. The coating formulations were prepared by adding $TaCl_5$ powder gradually to n-butanol while stirring, giving a cloudy solution. Lead ruthenate powder, as prepared in Example 2, was added to this solution to give the proper ratio of lead ruthenate to tantalum oxide in the applied films. Coatings containing 75 w/o lead ruthenate-25 w/o tantalum oxide did not adhere well whether fired at 450°, 550° or 650° C.

The 50:50 proportion gave generally better adherence which varied with firing cycle, with the 650° C. cycle giving the best relative result. However, even this coating showed some loss in the "Scotch Tape Test" for adherence.

The best adherence was obtained with the composition 25:75 lead ruthenate-tantalum oxide. In this case, the 450° C. firing cycle gave good adherence, and the 550° and 650° C. cycles gave somewhat better adherence with no significant difference between the 550° C. and 650° C. samples.

A single coat of the 25:75 lead ruthenate-tantalum oxide composition gave a heavy loading, about 10 g per square meter. This coating had excellent surface conductivity with resistance of about one ohm per square.

EXAMPLE 5

An electrode having a prior art 70:30 Pt-Ir composite coating was prepared as described U.S. Pat. No. 3,177,131 at a loading of 15 g/m$^2$ on a titanium substrate. A second electrode was prepared on a similar titanium substrate, as described, then overcoating, as described in Example 4, with the 75 w/o lead ruthenate-tantalum oxide composite. When tested as an anode in a laboratory chlorate cell containing about 300 g/l, NaCl at a pH of about 6.5 to 7, a temperature of about 60° C. at a current density of 1 amp/in$^2$, the prior art electrode exhibited an overpotential of approximately 52 mv, while the overpotential of the promoted electrode was approximately 60 mv. This example demonstrates that the catalytic activity of the lead-ruthenate tantalum oxide composite is substantially identical to that of the prior art platinum-iridium composite electrodes.

EXAMPLE 6

Anodes as set forth in Example 4, containing 75 w/o Tantalum oxide and 25 w/o lead ruthenate, were also evaluated for durability under conditions which produce sodium hypochlorite, as either a final or an intermediate product. The electrolyte contained 63 g/l NaCl at ambient temperature, initially and starting pH was about 7. The cells were operated until half of the initial salt content was converted to NaOCl, giving a final solution containing 40 g/l NaOCl, at which time the cells were emptied and refilled with fresh brine. Titanium cathodes were used. A current density of 5 Amps per square inch was used to produce accelerated wear.

Samples were prepared in two thicknesses, one approximately 10 g/m$^2$ obtained by a single application and firing, and the second thickness being about 20 g/m$^2$ obtained by two applications and firings. These samples passivated very quickly. At constant voltage, some started to pass less current after one or two hours of operation, and all had passivated to the degree that little or no current was passed after 25 to 72 hours. Thus, these anodes would be unsuitable for sodium hypochlorite production. Coating thicknesses were measured by the beta backscatter method. The passivated samples still exhibited the initial coating thicknesses and surface electrical conductivity.

Although the electrocatalytic activity of this example demonstrates that the lead ruthenate-tantalum oxide composite coated electrode is substantially equivalent to that of the platinum-iridium composite coated electrode, the lead ruthenate-tantalum oxide composite coating does not have the durability of the platinum-iridium composite under conditions of extended electrolysis.

EXAMPLE 7

Degreased titanium samples were coated with 2 g/m$^2$ of 70:30 Pt:Ir by weight, by applying a solution of hexachloroplatinic and hexachloroiridic acids in n-butanol, then firing at 550° C. for 15 minutes. This procedure was repeated on some of these samples to produce coats with loadings of 4 g/m$^2$. Both types of precoated samples were then coated with 20 g/m$^2$ of lead-ruthenium-tantalum oxygen composite, as described in Example 5. When tested in hypochlorite cells, as set forth in Example 6, these samples operated stably for more than 72 hours. Since catalytic activity had been demonstrated, further life tests were not conducted, as the life of these samples was expected to be so long that life testing would be impractical under these conditions.

EXAMPLE 8

The procedure of Example 7 was repeated, except that small amounts of Pt and Ir were added as chloride salts to the alcohol formulation used to produce the topcoat. The topcoat had the following nominal composition after firing:

| | Parts by Weight |
|---|---|
| Lead ruthenate | 22.2 |
| Tantalum oxide | 66.6 |
| Platinum | 7.9 |
| Iridium | 3.4 |

Since the chloride salts are soluble in n-butanol, the distribution of Pt, Ir and tantalum in the fired film can be considered to be very uniform.

The nominal weight ratio of lead ruthenate to tantalum oxide in the topcoat was 1:3, and the Pt:Ir ratio was 70:30. After firing at 550° C., these anodes were compared in an accelerated sulfuric acid test to samples prepared with no undercoat, and samples coated only with about 4 g/m$^2$ of Pt-Ir and no topcoat.

Because durable coatings will predictably run for years in hypochlorite cells, even at higher than normal current density, a more severe accelerated test was used to compare time to passivation of experimental coatings with coatings known to have long life. Since it is thought that the small amounts of oxygen produced during evolution of chlorine products contributed greatly to the wear of previous precious metal coatings, a cell which evolves only oxygen at the anode was selected. This cell uses a titanium cathode immersed in 220 g/l of $H_2SO_4$ electrolyte at a temperature of about 36° to 48° C. using an anode current density of about 5 Amps/in$^2$. These conditions are somewhat similar to those used in electrowinning of metals, but are much more severe so as to produce accelerated wear.

The life results are summarized in Table I. Samples having ruthenium oxide-tantalum oxide coatings exhibited behavior comparable to Anode A in this test.

TABLE I

| | Loadings of Pb, Ru Ta, Pt, Ir Composite Topcoat | Loading of Pt—Ir Undercoat | Passive At Amp-hrs. | Coating Loss |
|---|---|---|---|---|
| A. | 20g/m$^2$ | — | 172 | 0 |
| B. | 20g/m$^2$ | 2g/m$^2$ | 4631 | 0 |
| C. | 20g/m$^2$ | 4g/m$^2$ | 12912 | 17% |
| D. | — | 4g/m$^2$ | 7216 | 90% |

These results, taken together with earlier results presented above, demonstrate that the addition of lead ruthenate-tantalum oxide composite to the outer layers of the Pt-Ir composite film will unexpectedly promote its ability to maintain high catalytic activity over extended periods of electrolysis. They further demonstrate the unexpected benefit of combining a small amount of Pt-Ir in the topcoats with a Pt-Ir undercoat. They also show the increased durability achieved with heavier loadings in the undercoats. The difference in coating loss between samples C and D is considered highly significant. In commercial use, anodes corresponding to sample D, but with a loading of 15 g/m$^2$ will typically last at least five years in chlorine production. FIG. 1 presents the results of an Auger analysis on a specimen corresponding to sample C, revealing the distribution of the various heavy elements as a function of distance from the surface. This method reveals nothing about the distribution of oxygen because of its relatively small atomic weight.

EXAMPLE 9

Anodes prepared as described in Example 8, Sample C were compared to prior art Pt-Ir anodes prepared as set forth in Example 5 in an accelerated sulfuric acid test which was similar to that set forth in Example 8, except that the electrolyte was 2 Molar sulfuric acid at ambient temperature. Table I sets forth the time to failure of both types of anodes as a function of current density.

TABLE II

| Current Density (Amp/in$^2$) | Time to Failure (hours) Pt—Ir | Present Invention |
|---|---|---|
| 8 | 160 | 550 |
| 5 | 530* | Greater than 760 |
| 4 | 410 | 1700 |

*average of 285, 1200, 320 and 480.

This example demonstrates that anodes of the present invention having a Pt-Ir content of about 7 gm/m$^2$ are at least fully comparable under the conditions of this test to prior art anodes with a Pt-Ir content of about 15 gm/m$^2$. From this, it can be inferred that these coatings would attain a life which should be at least comparable to that obtained with the prior art Pt-Ir coatings in chlorine production.

EXAMPLE 10

A group of 96 electrodes of production size was prepared as described in Example 8, Sample C. The electrodes were installed in a commercial brine electrolysis plant and operated successfully for 9 months. At the end of that period, an anode was removed and sections were cut from it and prepared for laboratory cell characterization.

When tested according to the procedure set forth in Example 5, one such sample was found to have an overpotential of 62 mv at a current density of 150 ma/cm$^2$, indicating that high catalytic activity had been retained by the electrode. A second section of the electrode operated for 953 hours at 5 ASI in the sulfuric acid accelerated life test, described in Example 8, indicating that much of the resistance of the electrode to passivation had been retained. While it was difficult to obtain a precise measurement of wear rate due to the small loss of coating, it appears that the life of the anodes will be at least comparable to that of prior art Pt-Ir coated anodes in brine electrolysis.

EXAMPLE 11

The procedure of Example 8, anode B was repeated, except that after application of the two coats of lead ruthenate a further overcoat of 3 g/m$^2$ of Pt-Ir was applied. Each coat was fired in air at 550° C. When tested in accordance with the accelerated life test described in Example 8, the performance of this anode was substantially equivalent to that of Anode C in Example 8.

As our invention, we claim:

1. An electrode having a valve metal substrate and a lead-tantalum-titanium-platinum iridium ruthenium-oxygen composite layer formed on said valve metal substrate, the composite layer having a platinum-iridium rich zone adjacent the substrate, the concentrations of platinum and iridium being higher in the platinum-iridium rich zone than throughout the rest of the lead-tantalum-titanium-platinum iridium ruthenium-oxygen composite layer.

2. An electrode having a valve metal substrate and a catalytic layer formed thereon, the catalytic layer having a platinim-iridium rich zone and a lead-ruthenium-tantalum-oxygen rich zone, the platinum-iridium rich zone being adjacent to the valve metal substrate and the lead-ruthenium-tantalum-oxygen rich zone being disposed exterior to the platinum iridium zone.

3. The electrode of claim 2 wherein the lead-ruthenium-tantalum-oxygen rich zone containing
from about 10 to about 16 w/o lead;
from about 40 to about 65 w/o tantalum;
from about 5 to about 7.5 w/o ruthenium;
from about 10 to about 20 w/o oxygen.

4. The electrode of claim 2 wherein the catalytic layer is formed by the process comprising:
(a) applying from about 2 to about 6 g/m$^2$ (calculated as metal) of an admixture of platinum-iridium compounds to the valve metal substrate, the platinum-iridium compound admixture consisting essentially of
from about 20 to about 40 w/o thermally decomposable iridium compound, and
from about 60 to 80 w/o thermally decomposable platinum compound (both calculated as metal)
(b) firing the electrode at a temperature of from about 350° C. to about 550° C.;
(c) then applying an admixture of lead-ruthenate and thermally decomposable tantalum and platinum group metal compounds, the admixture of lead ruthenate and thermally decomposable tantalum and platinum group metal compounds consisting essentially of:
from about 20 to about 25 w/o lead ruthenate;
from about 60 to about 75 w/o thermally decomposable tantalum compound
from about 6 to about 11 w/o thermally decomposable platinum compound; and
from about 2.5 to about 5 w/o thermally decomposable iridium compound (the respective percentage being calculated as lead ruthenate, tantalum oxide, platinum and iridium)
(d) firing the electrode at a temperature of from about 350° to about 550° C., the total amount of lead ruthenate and thermally decomposable tantalum and platinum and iridium compounds applied being sufficient to result in a loading of at least about 10 g/m$^2$.

5. The electrode of claim 4 wherein said valve metal is titanium.

6. The electrode of claim 2 wherein said valve metal is titanium.

7. The electrode of claim 2 wherein the total thickness of said catalytic layer is less than about 5 microns.

8. A method of electrolyzing an aqueous halide salt solution, comprising passing an electrolysis current through the halide salt solution between an anode and a cathode, said anode comprising a valve metal substrate having a catalytic layer thereon, the catalytic layer having a platinum-iridium rich zone adjacent the valve metal substrate and a lead-ruthenium valve metal oxygen rich zone upon the platinum-iridium rich zone.

9. The method of claim 8 wherein the valve metal is titanium and said halide is a chloride.

10. The method of claim 9 wherein the electric current is passed through the chloride solution at a current density of between about 1 and 7 amp/in$^2$, based on the geometric area of the catalytically-coated portion of the substrate.

11. The electrode of claim 1 wherein at least a portion of said lead-tantalum-titanium-platinum iridium ruthenium-oxygen composite is present as lead ruthenate.

12. The electrode of claim 2 wherein at least a portion of the lead, ruthenium and oxygen in said lead-ruthenium-tantalum-oxygen rich zone is present as lead ruthenate.

13. The electrode of claim 3 wherein at least a portion of the lead, ruthenium and oxygen in said lead-tantalum-ruthenium oxygen rich zone is present as lead ruthenate.

14. The method of claim 8 wherein at least a portion of the lead, ruthenium and oxygen in said lead-ruthenium valve metal-oxygen rich zone is present as lead ruthenate.

* * * * *